United States Patent [19]

Eiteljorg

[11] Patent Number: 4,510,703

[45] Date of Patent: Apr. 16, 1985

[54] SKI BOOT

[76] Inventor: Harrison Eiteljorg, 142 Grays La., Haverford, Pa. 19041

[21] Appl. No.: 450,764

[22] Filed: Dec. 17, 1982

[51] Int. Cl.[3] ..... A43B 5/04

[52] U.S. Cl. ..... 36/119; 36/58.5; 36/117; 24/68 SK

[58] Field of Search ..... 36/58.5, 117, 118, 119, 36/121, 120; 24/68 SK, 70 SK, 69, 70

[56] References Cited

U.S. PATENT DOCUMENTS

| | | | |
|---|---|---|---|
| 338,981 | 3/1886 | King | 36/58.5 |
| 722,069 | 3/1903 | Wilt | 36/58.5 |
| 892,760 | 7/1908 | Nelson | 36/58.5 |
| 3,235,981 | 2/1966 | Kloss | 36/58.5 |
| 3,408,754 | 11/1968 | Kueter . | |
| 3,529,368 | 9/1970 | Canfield . | |
| 3,538,627 | 11/1970 | Labat-Camy . | |
| 3,599,351 | 8/1971 | Check . | |
| 3,657,827 | 4/1972 | Rieker | 36/117 |
| 3,718,994 | 3/1973 | Spier | 36/117 |
| 3,758,965 | 9/1973 | Caberlotto | 36/117 |
| 3,849,914 | 11/1974 | Bertele . | |
| 3,854,743 | 12/1974 | Hansen . | |
| 3,883,964 | 5/1975 | Check | 36/119 |
| 4,160,332 | 7/1979 | Salomon . | |
| 4,190,970 | 3/1982 | Annovi . | |
| 4,192,087 | 3/1980 | Salomon . | |
| 4,222,184 | 9/1980 | Kostinger . | |
| 4,245,410 | 1/1981 | Molitor | 36/117 |
| 4,253,251 | 3/1981 | Salomon | 36/119 |
| 4,280,286 | 7/1981 | Sartor . | |
| 4,308,674 | 1/1982 | Tessaro . | |
| 4,387,517 | 6/1983 | Annovi | 36/117 |

FOREIGN PATENT DOCUMENTS

| | | | |
|---|---|---|---|
| 0057170 | 1/1982 | European Pat. Off. | 36/117 |
| 2335679 | 7/1973 | Fed. Rep. of Germany | 24/69 SK |
| 2045321 | 2/1971 | France . | |
| 2075412 | 10/1971 | France . | |

OTHER PUBLICATIONS

Bulletin Officiel de la Propriete Industrielle.

*Primary Examiner*—Henry S. Jaudon
*Assistant Examiner*—Mary A. Ellis
*Attorney, Agent, or Firm*—Steele, Gould & Fried

[57] ABSTRACT

A boot for wear by a user while skiing has a sole member for attachment to a ski binding, a first half shell, rigidly attached to the sole member and forming the sides and rear of the boot, and a second half shell, removably attachable to the first half shell and forming the front and top of the boot. Attachment belts mounted inside the first half shell affix the user's foot and leg only to the first half shell, which forms the back and sides. The second half shell provides support and stiffening for the first half shell when attached thereto, without directly contacting the user's foot or leg.

10 Claims, 5 Drawing Figures

SKI BOOT

BACKGROUND OF THE INVENTION

1. Field of the Invention

This invention relates to the field of footwear, and in particular to a hard shell molded ski boot formed in two interfitting shell members.

2. Description of the Prior Art

A downhill ski boot is intended to make the user's foot and lower leg rigidly attachable to a ski. Steering motions of the user's lower leg, primarily consisting of tilting movements from side to side over the ski, must be fully and precisely transmitted to the ski for the most complete possible control. Tilting motions forward and backward over the ski are less important for steering, but have other effects. Fatigue can also be reduced by use of a boot which provides some support in the forward-bckward directions, allowing the user to assume a comfortable position, for example, leaning forward slightly.

It will be appreciated that to convey a certain side-to-side tilting movement precisely, the structure attaching the ski to the user's lower leg must be substantially rigid in the side-to-side plane. The prior art includes a number of ski boots adapted to attach a user's leg and ski, using a hard sole-block fixed to a relatively high point on the user's shin, by means of a rigid or only slightly resilient connecting structure.

Ski boots having hard molded plastic shells have been popular for some years. Such boots allow a relatively rigid connection between the wearer and the ski, usually via a sole-block molded monolithically with an upwardly extending portion on the front or rear of the boot. The extending portion encloses the user's lower leg. Often, the upward extension is adapted to pivot forward and backward with respect to the ski, around an axis passing horizontally through the user's ankle, the axis being transverse to the direction of travel. Such pivoting causes the side-to-side tilting motions of the user to be directly transmitted to the ski, but permits the user to lean forward and backward over the ski freely. Adjustable spring biasing means to set the extent to which the user can freely lean forward and backward are also known in connection with such pivoting ski boots.

In order to affix a user's leg to a boot tightly, and especially to a hard plastic shell boot, the art teaches several alternative procedures. In some boot designs, surface members have flaps which, although themselves stiff, may be adjustably brought together or slid across one another to reduce the circumference of a part of the boot enclosing the user's foot or leg. This approach is much like the traditional means of tightening footwear, namely flaps which are brought together by means of laces, in order to adjust the circumference of a part of the shoe or boot member enclosing the user's foot and/or leg.

A formerly popular method of attaching a molded boot having a hard plastic shell to a user's foot involved molding a custom inner boot to the exact contour of the user's foot, and enclosing the custom molded inner member in a hard outer shell of standard dimensions. The inner boot was molded in situ, that is, using the user's foot and leg for a part of the mold form. The exact contours of any user's foot could thereby be encompassed by a standard sized hard plastic boot shell.

The custom molded inner member was formed of insulating material, and was at least semi-rigid for support.

Currently-popular custom boots employ foam pads within hard shell outer boots. Such an approach is similar to the use of a custom-molded inner boot in that the resilient insulating material may be correctly sized for precise fit. Unlike custom molding, no special molding equipment or curable pre-cursor foam material need be used.

Although custom boots, however, made, may fit absolutely perfectly when made, the boots cannot account for typical variations in the size of a given user's foot over time. In addition, the semi-rigid lining material which was originally fit to the user's foot, tends to become worn and crushed by the user's motions in walking and skiing, gradually enlarging the space allowed for the user's foot. Therefore, the prior art also teaches means for adjustably tightening the fit of even custom fitted boots.

Known tightening means include a bale or pivotable loop adapted to fit into any of a series of spaced hooks, an adjustable pressure plate for pressing against the user's instep, and belt members extending through the boot and connected to an external adjustment means. With use the boot wears and the original precision of the custom fit is lost. Similarly, should the user's feet swell or shrink, the custom fitted pads no longer precisely fit the user's feet. In these situations, the adjustment device effectively becomes the basic means and support by which the user's foot is attached to the ski.

Inadequacies in fit are aggravated by closures or tighteners which can be set only at discrete intervals. The user may find that the boot is too tight at one position and too loose at the next. In any event, once the usual tightener is moved into an operative position at which the tightener contacts the user's foot, the precision of the original fit is of no consequence, because the tightener, not the overall boot, accomplishes the structural interconnection of user and ski.

The user must tighten the adjustment means to close the liner around his foot tightly enough at the adjustment point to make up for any inadequacies in fit caused by wear of the lining material. Such tightening further compresses the liner and further deteriorates the fit. Even given the various means for custom fitting the inner contour of the boot, and means for adjusting the pressure exerted at various points within the custom-molded boot, the user still finds that all too frequently, the boot is either too tight or too loose. If too loose, the user loses a measure of control over steering the skis, due to loss of full control over the precise tilt applied from side to side to the skis. Looseness also permits relative movement between the user and the boot, often abrading the user'leg, especially at the shin, adjacent to the boot top. If the adjustment means are too tight, the user will be not only uncomfortable, but may develop frostbite due to undue pressure and lack of circulation. Whether the boot is too tight or too loose, poor fit can cause blisters.

The tightness of the connection between the user and the boot (and therefore the ski) can help or hinder the user's safety. If boots are too loose, the skis are more difficult to steer around obstacles. Loose boots will not support the wearer's bones and joints well in falls, leading to more frequent breaks and strains. On the other hand, if the boots are too tight, the wearer's feet will become numb. Frostbite is a primary danger, but in addition, a user with numb feet will be less able to discern the condition of the skis, the precise snow surface, and other possibly subtle tactile clues. The optimum boot is, of course, one which conforms identically to the user's foot with every wearing. The boot is loose enough for comfort and circulation and tight enough to convey directly leg movements to the ski and prevent chafing between the user and the boot.

The present invention provides a means by which the user's foot and lower leg are custom fitted to the bottom and back of the boot each and every time the boot is put on. The front cover member of the boot fits integrally into a series of recesses providing structural attachment with the rear member, closing the boot to snow and moisture, and providing additional structural support and rigidity. Interchangeable front covers allow the user to choose from a range of support parameters. The front cover shell does not close tightly against the user's leg, which might possibly obstruct blood circulation. The bottom and back-mounted adjustment means is continuously-adjustable, rather than adjustable only to one of a series of discrete positions, preferably using attachment belts having loop and pile fasteners. The attachment belts are affixed to the inner surfaces of the boot at spaced points, further securing the user's foot and leg to the bottom and rear of the boot.

SUMMARY OF THE INVENTION

It is an object of the invention to provide a ski boot which substantially rigidly attaches a user's leg to a ski.

It is also an object of the invention to provide a ski boot which is comfortable yet tight fitting when new, and still fits tightly and comfortably as the boot wears.

It is another object of the invention to provide a choice of interchangeable resilient members for a ski boot, whereby a user can choose the stiffness and angular tilt of the boot as required for particular skiing conditions and user perferences.

It is yet another object of the invention to maximize comfort in a ski boot which tightly attaches a user's foot to a ski, and at the same time to minimize the expense and complication thereof.

These and other objects are accomplished by a boot for wear by a user while skiing, comprising a sole member for attachment to a ski binding, a first half shell, rigidly attached to the sole member and forming the sides and rear of the boot, and a second half shell, removably attachable to the first half shell and forming the front and top of the boot. Attachment belts mounted inside the first half shell directly affix the user's foot and leg only to the first half shell, which forms the back and sides of the boot. The second half shell provides support and stiffening for the first half shell when attached thereto, without directly contacting the user's foot or leg.

BRIEF DESCRIPTION OF THE DRAWINGS

There are shown in the drawings the embodiments which are presently preferred. It should be understood, however, that the invention is not limited to the precise arrangements and instrumentalities shown therein.

DETAILED DESCRIPTION OF THE PREFERRED EMBODIMENTS

Figure 1:
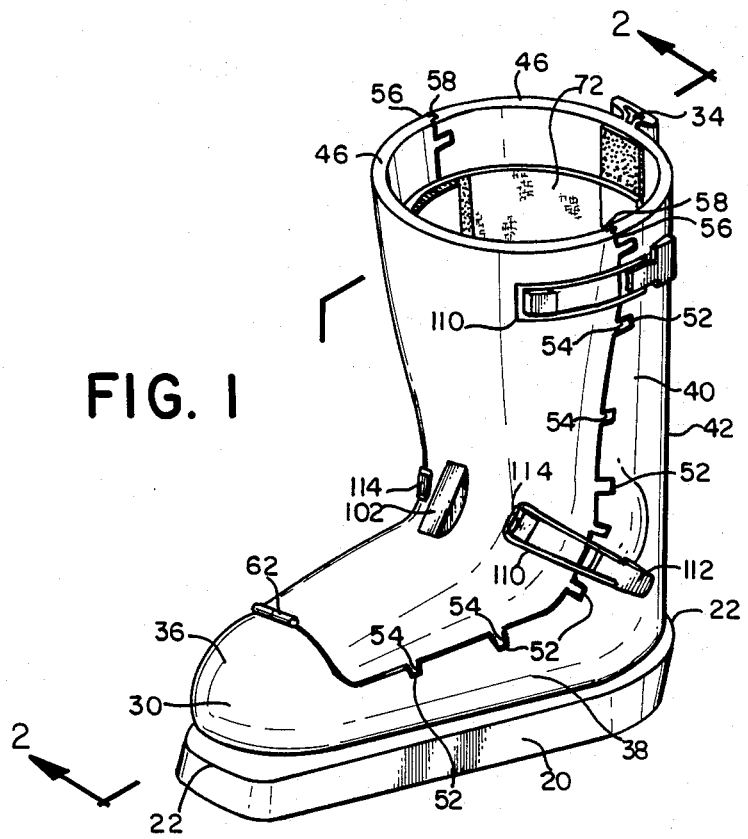
FIG. 1 is a perspective view of the ski boot of the invention.

The boot of the invention, as shown in FIG. 1, externally conforms to the traditional boot shape, that is, to the general contours of the user's foot and lower leg. In order to attach the boot (and thereby the foot and leg) securely to a ski, sole block 20 is cut sharply around edges 22, providing a protruding edge for engaging a ski binding (not shown). The objective is tightly yet comfortably to attach the user's foot and lower leg to the ski such that side-to-side tilting is transmitted fully to the ski, while fore and aft tilting over the ski is more or less restricted.

The boot of the invention is formed in two half shell members. The toe, sides and rear of the shoe portion, and the rear part of the upward extending leg portion, are formed as one-part half shell 30, which is integral with the sole block 20, for example molded in one piece. Accordingly, but for the front and insole cover, namely half shell 50, the boot is formed from a single unbroken piece. The front and insole cover 50 is a separable member which is rigidly attachable to the side/back half shell 30 by means of toe hinge 62, bales 110, and an interlocking edge contour structure.

As assembled, the boot forms generally tubular structures for the foot and the leg, the tubes being joined at a right angle for the user's ankle, and closed at the toe. The outer shell is of hard molded plastic. The lightweight, impact-resistant plastic shell 46 is sufficiently strong to provide substantially rigid support. Moreover, a structure defining a full circumference shell (i.e., a closed circular structure) is much stronger than a similar thickness of material in a sheet or open curve. Accordingly, the boot of the invention, when closed, is quite strong. When open or unlatched, the boot is much more resilient, permitting comfortable walking.

The user takes the boot off, or puts the boot on, by opening bales 110, disposed on both sides of the boot, and rotating front shell 50 forwards around hinge 62. Hinge 62 is separable into two parts when the boot is open, the hinge pin being attached rigidly to one of the two parts. Front shell 50 may be rotated around the hinge, clear of the opening needed for the user's foot. Shells 30 and 50 can then be separated by separating the hinge parts. After opening the boot by rotating open the front shell 50, the user lays open the two sides of each of the attachment belts 72 and 74, places his foot in the boot, and closes the belts. Belts 72 and 74 are mounted only to the sole and rear portions, that is, to parts of half shell 30.

When top/front half shell 50 is rotated into closed position and locked down, half shell 50 contributes substantially to the strength and rigidity of the overall boot structure. This strength is achieved without a rigid front member in contact with the user's skin. Accordingly, there is no abrasion of the user's shin, as is a problem with many hard-shell plastic boots. Instead, the user's foot and leg are comfortably and at least somewhat resiliently urged downward and rearward, clear of half shell member 50. Shell member 50 waterproofs the enclosure, protects the user and tends to stiffen the boot. Shell 50 does not directly support the user's foot, but rather influences the resilience of the primary support, half shell 30, when the boot is closed.

Figure 2:
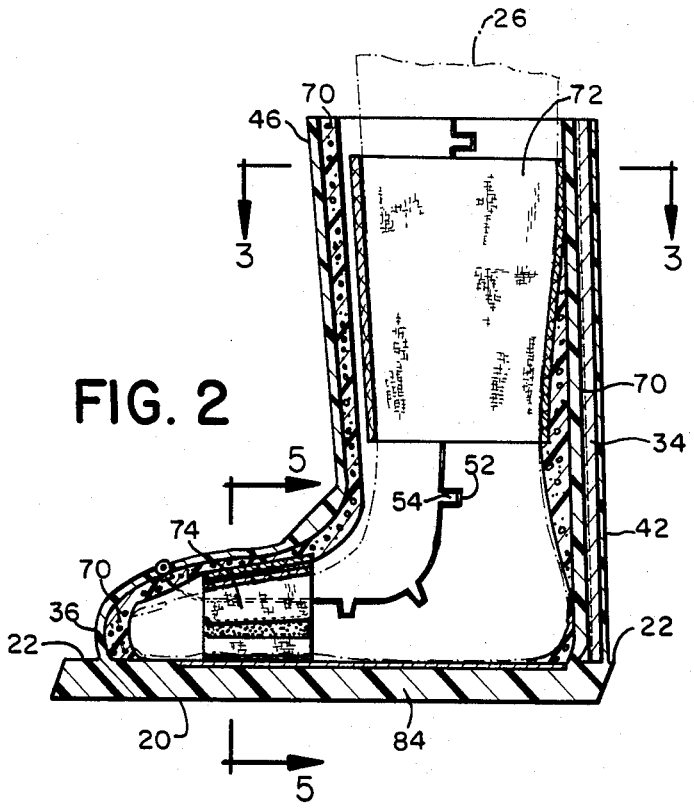
FIG. 2 is a section view taken along line 2—2 in FIG. 1, the user's foot being shown in dash-dot lines.

With further reference to FIG. 2, the rigidity of the side/back half shell 30 is partly determined by spine 34, slidably inserted into a complementary slot in the body of the boot, for example ridge 42 running along the rear of the boot. The spine also serves as one or more points of attachment for belt 72.

Spine 34 has a substantial effect on the rigidity of the boot. The spine is preferably made slidably removable. A selectable range of rigidities is possible by making spine 34 removable and providing a series of progressively stiffer spines. Attachment belt 72 is preferably mounted directly to spine 34, whereby if the belt becomes worn or broken, it can be replaced in the same manner, that is, by replacing spine 34, to which the belt 72 is mounted.

Figure 3:
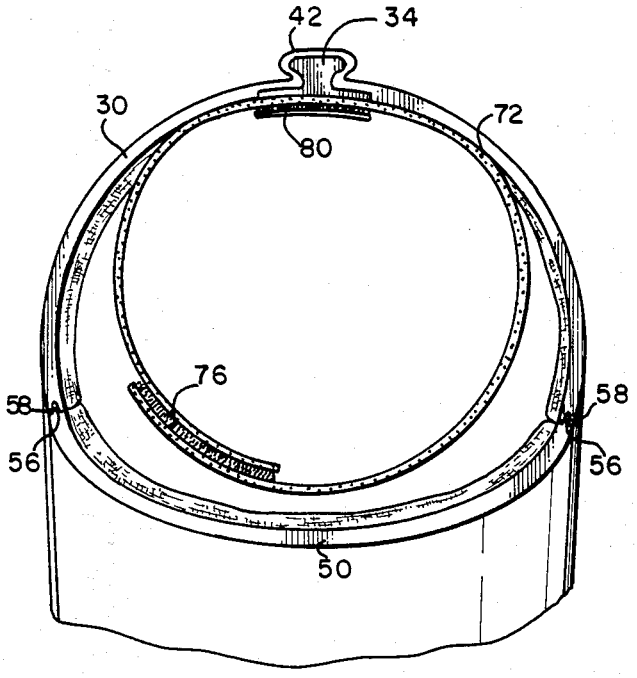
FIG. 3 is a section view taken along line 3—3 in FIG. 2.
Figure 4:
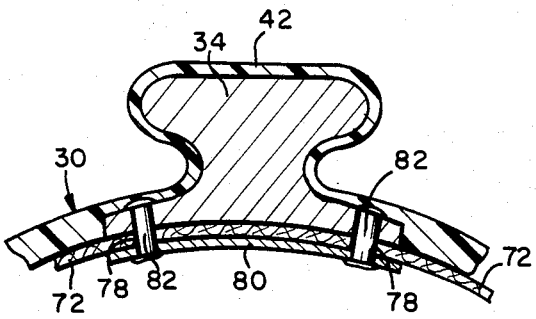
FIG. 4 is a detailed section view of the attachment belt mounting of FIG. 3.

In the preferred embodiment, spine 34 is snugly but removably fit into a keyed groove extending from sole block 20 to the top of the boot. A suitable cross-section for the groove (and spine) is shown in FIGS. 3 and 4.

The sole block is thick and therefore sufficiently rigid without need of reinforcement. The sole and leg portions may flex relative to one another. The stiffness of the boot is also substantially affected by the stiffness of top/front half shell 50 which is structurally attached when the boot is closed. The top/front half shell 50 may also comprise a reinforcing ridge 102, mounted, for example, at the junction between the instep (i.e., the upper surface of the foot) and the leg portions of half shell 50. By varying the size and composition of spine 34 and ridge 102, or either of them, the stiffness of the boot and even the forward tilt of the boot can be controlled. Should a user decide that snow conditions favor a different stiffness or a different fore-and-aft tilt than that employed initially, he need only change spine 34 and/or top/front half shell member 50.

Spine 34 and attachment belt 72 mounted thereto may be slidably withdrawn. The top/front half shell is likewise easily replaced. This is done by opening the boot and separating the two halves of hinge 62, and reversing the process with a new top/front half shell 50. Each alternative half shell 50 is provided with a hinge leaf that will join with the hinge leaf on shell 30, and a matching edge contour to be interlocked with the edge of side/rear half shell 30.

The particular stiffness and forward tilt will be a matter of choice to some extent, and will vary according to snow conditions and the user's expertise. In any event, a range of choice in stiffness and tilt is allowed.

The influence of top/front half shell 50 on the stiffness of the entire boot is dependent upon a good structural interconnection between the top/front half shell 50 and the side/rear half shell 30. This is accomplished not only by hinge 62 and bales 110, but also by a plurality of interfitting members along the abutting edges. Tabs 54 fit into slots 52, securing the closed boot against relative movement between half shells 50, 30. Moreover, a mating tongue and groove running longitudinally along the interconnecting edges of half shells 30, 50 further secure the two shell members against relative movement. The tabs and slots secure the half shells against relative movement in one plane, and the tongue and groove secures them against relative movement in a perpendicular plane. Fully interfitting tabs and slots may be omitted in the area of the ankle, to allow a small amount of flex and/or relative movement between the half shells at that area only, which is stressed as the boot flexes.

It is also possible to employ interchangeable top/-front half shells 50 to vary the angle of forward/backward tilt between the shoe portion and the leg portion of the boot. In order to accomplish this, the leg portion must be drawn forwards or pressed backwards from its rest angle before shell 50 may be fully closed. To move the tilt to a greater angle, the leg portion must be flexed backwards before the appropriate tabs 54 will align with slots 52. Conversely, if a smaller shell 50 is used, making the angle of forward tilt more acute, the bales 110 must be closed, thereby drawing the leg portion forward, before the junction between shells 30, 50 closes. The tilt can be varied over a limited range by choice of dimensions of shell 50. Once closed, the structure is stable. Interchangeable top shells 50 may also be made more or less stiff at a given angle, providing a range of flexibilities at that angle.

Bales 110 need not comprise adjustable closures, because no wear or tightness variations will be required as to the fit between the rigid shells. Enough span is, however, needed to engage protrusion 114 and draw the top/front shell closed. Bale 110 is a simple wire loop, pulled against protrusion 114 when pivotable tab 112 is pressed against the boot, and loosened when tab 112 is raised.

In order to secure the user's foot comfortably inside the boot, and relatively free of the influence of changes in fit, due, for example, to deterioration of internal padding which contacts the foot, the user's foot is attached only to the side/rear half shell 30. The upper, wider attachment belt 72 holds the leg to the rear. Accordingly, the user's shin remains spaced slightly from front shell 50, thereby preventing abrasion and/or bruising of the user's leg at the point it would otherwise contact the boot shell, namely at the upper front inside edge of the boot.

Attachment to the foot is accomplished by means of two spaced attachment belts, belt 74 crossing to user's instep, and belt 73 surrounding the user's shin. The attachment belts are comfortably wide and soft. Each belt comprises a pair of mating straps, mounted to the side/rear half shell at spaced points, whereby the user's foot and leg are restricted against play in a side-to-side direction, thereby further limiting the possibility of abrasion. Even if the strap pairs are attached along one vertical line, the fact that the user's leg is restrained from contacting the upper edge of the boot or padding results in a substantially more comfortable boot.

As shown in FIGS. 3 and 4, attachment belt 74 is preferably affixed by means of a plate 80 attached to the inside surface of spine 34 at spaced locations, for example by means of rivets 82. It is preferred that plate 80 be riveted or otherwise structurally affixed to at least a portion of reinforcing spine 34, which is removable. The straps forming attachment belt 74, extending from either side of plate 80, are effectively attached at two spaced lines, namely the edges of plate 80, precluding any substantial play between the user's leg and the boot in a side-to-side direction around plate 80.

The presently preferred embodiment comprises a single spine 34, having the appropriate keyed cross-section of FIG. 4, and having spaced attached surfaces for rivets 82 or the like. In order to increase stability of the connection between leg and boot, a pair of unconnected spines 34 can be used, for each end of strap 72. Wider spacing improves stability, up to a point. The closure allowing the user to tie and untie attachment belts 72 and 74 is preferably a continuously-adjustable closure, that is, lockable at any point in its range and not only at discrete increments. A slide fastener is one possible continuous attachment. Loop and pile fasteners 76 are preferred for continuously-adjustable attachment because such closures lock at any tightness over their range, and will admit of substantial misalignment and still attach securely. Suitable loop and pile fasteners are available under the trademark Velcro. The attachment belts, and especially upper attachment belt 72 must be as wide as convenient for comfort and good fit. In order to accommodate the particular curves and dimensions of a wearer's foot and leg, and further in order to accommodate the variations thereof due to temperature, sweating, weight gain and loss and the like, such continuously-adjustable and angularly-versatile closures are preferred.

Figure 5:
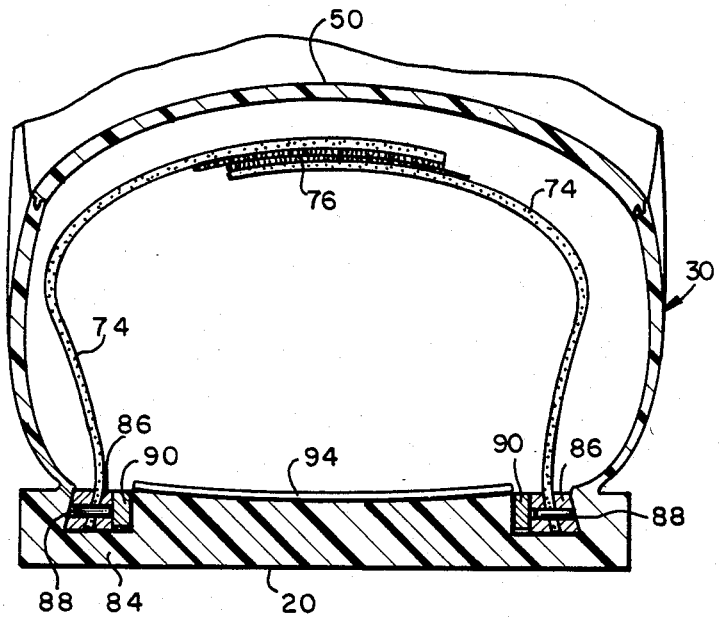
FIG. 5 is a partial section view taken along line 5—5 in FIG. 2.

The instep-attaching belt 74 is preferably mounted to sole block 20 at a pair of inserted rail members, each affixed using a dove-tailed tenon made in sections, which can be fitted into a dove-tailed mortise in sole block 20. Such an interconnection was used historically to lift stones and is known as a "lewis". These are spaced to the extreme side edges of the foot enclosure area and are restricted against movements by the particular structure. The grooves 84 for the sole rails run along the sides of sole block 20, and have a trapezoidal cross section. The ends of straps 74 are affixed to mounting rods or blocks 86, the rods having a slightly narrower trapezoidal cross section. The straps 74 and rods 86 may be attached for example, by rivets 88. As shown in FIG. 5, each rod 86 is held in its trapezoidal groove 84 by a spacer. Spacer member 90, forced into the square corner of the trapezoidal groove, presses the sloping edge of trapezoidal mounting rod 86 against the similarly sloped edge of slot 84. The effect is to hold securely the end of belt 74 against being pulled upwards from the slot. Accordingly, unlike the insertion of spine 34, the rods 86 may be transversely (i.e., downwardly) pressed into the slot rather than introduced endwise at an end of the sole member and slid into position along the slot. Like the leg belt 72, the instep belt 74 is preferably wide and has mating loop and pile fasteners at its free ends. Bottom sole plate or cover 94 is preferably padded, and employed to cover any surface irregularities due to spacer members 90 and the grooves in the sole block. Cover 94 also thermally insulates the bottom of the boot. If desired, the inner sole cover 94 may be a custom sized depression.

The trapezoidal groove and narrower trapezoidal inserted rail are reminiscent of the traditional "lewis" structure. In addition, however, the grooves or slots 84 of the sole block are preferably ridged in a direction transverse to the groove. Rods or blades 86 are ridged along a facing surface, whereby rods 86 are locked upon insertion against sliding fore and aft.

Leg belt 72 and instep belt 74 are preferably as wide as possible, in order to securely yet comfortably engage the user's foot. It is presently preferred that belts having webs of at least two to four inches in width be employed over the foot and three to seven inches over the skin. The leg belt 72 is preferably quite wide, for example of a width reaching from the user's ankle to near the top of the boot. It will be appreciated that, up to a limit, a wider belt is more comfortable, and locks more tightly. The wide belts should be sufficiently resilient to conform easily to the longitudinal and transverse curves which may be expected in typical feet. Although a larger number of narrower straps may be employed, single wide belts are more convenient and are preferred. It will be appreciated that the belts need only bear loop and pile surfaces along the interlocking strips at their free ends. The balance of the belts beyond the span of attachment, may be smoothed fabric or the like.

The hard shell molded boot of the invention has the advantages of the type of boot having a custom-fitted internal contour. In particular, the outer shell portions of the boot may be produced in a series of relatively few standard sizes, each shell size being adapted to accommodate a range of foot sizes. Due to the attachment belts 72 and 74, the standard shells will fit each such foot size equally well. Since the shell is of a standard size, top/front half shells 50 of various rigidities may be produced in the standard size, each having the required contour to match the tab-slot and tongue-groove interfitting mechanism. Moreover, the tilt of the boot can be adjusted by locking shell 30 against an appropriately-sized shell 50. Bales 110 need have no adjusting means, as all the alternative front half shells 50 will be adapted to the same positioning of fasteners, each having the bale-engaging protrusion 114 at the appropriate spot. The result is a series of selectable rigidities and/or tilts, without the huge number of variations or complex adjusters which would be needed to produce such a range for each size.

Inasmuch as the boot is effectively custom fit to the user each time the boot is put on, crushing or deterioration of thermal insulation 70 will not degrade the fit of the boot. The insulation should conform to the user's foot for good comfort and support, even though the primary means of support are the attachment belts 72 and 74.

The invention is capable of a number of further variations which will now be apparent to persons skilled in the art. Reference should be made to the appended claims rather than the foregoing specification as indicating the true scope of the subject invention.

What is claimed is:

1. A boot for wear by a user while skiing, comprising:

a sole member for attachment to a ski binding;

a first half shell rigidly affixed to the sole member and forming a toe, sides and a back for the boot, said first half shell extending in use under and alongside the user's foot and lower leg;

a second half shell, mountable on the first half shell, and extending in use over and in front of the user's foot and lower leg, the first and second half shells being rigidly engageable along complementary mating edges thereof, the first and second half shells together enclosing the user's foot and lower leg when in use;

a first means including a belt attached to the sole member for tightly affixing the user's foot to the sole member at the instep; and, a second means including a belt attached to the first half shell at a point above the sole member, for tightly affixing the user's lower leg at the shin to the first half shell at said point, said first and second means affixing the user's foot to the first half shell and spacing the user's lower leg from the second half shell.

2. The boot of claim 1, wherein said second half shell is hingeably mounted to the first half shell adjacent the toe, and further comprising means for clasping the first half shell and second half shall together.

3. The boot of claim 1, wherein one of said half shells is longitudinally grooved along a portion thereof contacting the other of said half shells, and the other of said first and second half shells has a longitudinal tongue for interfitting the groove.

4. The boot of claim 1, wherein one of said half shells comprises a plurality of tabs extending from the mating edge thereof, the other of said half shells having a plurality of receptacles for engaging the tabs.

5. A boot for wear by a user while skiing, comprising:

a sole member for attachment to a ski binding;

a first half shell rigidly affixing to the sole member and forming a toe, sides and a back for the boot, said first half shell extending in use under and alongside the user's foot and lower leg;

a second half shell, mountable on the first half shell, and extending in use over and in front of the user's foot and lower leg, the first and second half shells being rigidly engageable along complementary mating edges thereof, the first and second half shells together enclosing the user's foot and lower leg when in use; and first and second means for tightly affixing the user's foot and lower leg to the sole member and first half shell, said means comprising a first adjustable attachment belt, removably mounted to the sole member for enclosing the user's foot, the first adjustable belt having enlarged members at each end thereof, the sole member having longitudinal slots at spaced points to receive and secure the enlarged members, and a second adjustable attachment belt, mounted to the first half shell, for enclosing the user's lower leg at a space from the sole member.

6. The boot of claim 5 wherein the enlarged members of the first attachment belt fitting in slots in the sole member and further comprising a spacer urging the enlarged members against sides of the slots, whereby the first attachment belt is removably anchored to the sole member.

7. The boot of claim 6, wherein the enlarged members and slotted sole member are complementarily ridged, on facing surfaces thereof, in a direction transverse to the slotted sole member, whereby fore and aft movement is restricted.

8. A boot for wear by a user while skiing, comprising:

a sole member for attachment to a ski binding;

a first half shell rigidly affixed to the sole member and forming a toe, sides and a back for the boot, said first half shell extending in use under and alongside the user's foot and lower leg;

a second half shell, mountable on the first half shell, and extending in use over and in front of the user's foot and lower leg, the first and second half shells being rigidly engageable along complementary mating edges thereof, the first and second half shells together enclosing the user's foot and lower leg when in use; and means for tightly affixing the user's foot and lower leg to the sole member and first half shell, at least one of the first and second half shells comprising a changeable resilient portion, whereby the user can choose between rigidities of the boot for a predetermined skiing condition by choosing a changeable resilient portion.

9. The boot of claim 8, wherein the changeable resilient portion is a stiffening spine removably enclosed in the first half shell.

10. The boot of claim 9, wherein the means for affixing the user's foot and lower leg is at least partly mounted to a changeable resilient portion.

* * * * *